US005380163A

United States Patent [19]

Fujii et al.

[11] Patent Number: 5,380,163

[45] Date of Patent: Jan. 10, 1995

[54] GAS GUIDING MECHANISM IN A PISTON TYPE COMPRESSOR

[75] Inventors: Toshiro Fujii; Hiromi Kitayama; Hitoshi Inukai; Koichi Ito, all of Kariya, Japan

[73] Assignee: Kabushiki Kaisha Toyoda Jidoshokki Seisakusho, Kariya, Japan

[21] Appl. No.: 199,812

[22] Filed: Feb. 22, 1994

Related U.S. Application Data

[63] Continuation-in-part of Ser. No. 195,366, Feb. 10, 1994, which is a continuation-in-part of Ser. No. 154,279, Nov. 18, 1993, which is a continuation-in-part of Ser. No. 103,888, Aug. 6, 1993, abandoned, which is a continuation-in-part of Ser. No. 102,588, Aug. 5, 1993, which is a continuation-in-part of Ser. No. 101,927, Aug. 4, 1993, which is a continuation-in-part of Ser. No. 101,178, Aug. 3, 1993.

[30] Foreign Application Priority Data

Feb. 23, 1993 [JP] Japan ..... 5-033711

[51] Int. Cl.[6] ..... F04B 49/00

[52] U.S. Cl. ..... 417/242; 417/269; 251/310

[58] Field of Search ..... 417/242, 269; 91/480, 91/484, 499, 502; 251/310

[56] References Cited

U.S. PATENT DOCUMENTS

| | | | |
|---|---|---|---|
| 1,367,914 | 2/1921 | Larsson . | |
| 2,160,978 | 6/1939 | Mock | 417/269 |
| 3,288,432 | 11/1966 | Ferrin et al. | 251/310 |
| 4,007,663 | 2/1977 | Nagatomo et al. | 91/499 |
| 5,232,349 | 8/1993 | Kimura et al. | 417/269 |
| 5,286,173 | 2/1994 | Takenaka et al. | 417/269 |

FOREIGN PATENT DOCUMENTS

| | | |
|---|---|---|
| 350135 | 3/1922 | Germany . |
| 392587 | 4/1991 | Japan . |

*Primary Examiner*—Richard A. Bertsch
*Assistant Examiner*—Michael Kocharov
*Attorney, Agent, or Firm*—Brooks Haidt Haffner & Delahunty

[57] ABSTRACT

A piston type compressor is disclosed, which comprises a cylinder block having axial cylinder bores, pistons defining compression chambers in the bores, a drive shaft, and a gas suction and discharge chambers in a housing. A valve receiving chamber is formed around the drive shaft in the cylinder block, for accommodating a rotary valve which rotates in synchronism with rotation of the drive shaft. The rotary valve has a suction passage formed therein for providing gases from the gas suction chamber to a compression chamber during the chamber's gas suction stroke. A plurality of gas communication passages are formed in the cylinder block in association with the compression chambers, each having a first port open to the associated cylinder bore and a second port open to the valve receiving chamber. The first port is located at a position (P2) apart by a predetermined distance (L) from a top dead center position (P1) of the associated piston. The rotary valve has a bypass passage formed therein, for permitting one communication passage, isolated from both the compression chambers and the gas suction chamber, to communicate with another communication passage corresponding to a compression chamber in a compression stroke.

10 Claims, 5 Drawing Sheets

GAS GUIDING MECHANISM IN A PISTON TYPE COMPRESSOR

This application is a continuation-in-part of co-pending U.S. application Ser. No. 08/195,366 filed on Feb. 10, 1994, which is a continuation-in-part of U.S. application Ser. No. 08/154,279 filed on Nov. 18, 1993, which is a continuation-in-part of U.S. application Ser. No. 08/103,888 filed on Aug. 6, 1993, now abandoned, which is a continuation-in-part of U.S. application Ser. No. 08/102,588 filed on Aug. 5, 1993, which is a continuation-in-part of U.S. application Ser. No. 08/101,927 filed on Aug. 4, 1993, which is a continuation-in-part of U.S. application Ser. No. 08/101,178 filed on Aug. 3, 1993, all of which are incorporated herein by reference.

BACKGROUND OF THE INVENTION

1. Field of the Invention

The present invention relates generally to a piston type compressor that comprises a drive shaft, a cylinder block having a plurality of cylinder bores arranged around the drive shaft, and a plurality of pistons, which are retained in the cylinder bores and reciprocate with the rotation of the drive shaft. More particularly, this invention relates to a gas venting mechanism in a piston type compressor which is suitable for an air conditioner in a vehicle.

2. Description of the Related Art

A piston type compressor disclosed in, for example, Japanese Unexamined Patent Publication No. 3-92587, is provided with a cylinder block having a plurality of cylinder bores formed therein and pistons which both reciprocate in the cylinder bores and which define compression chambers in the bores. Each compression chamber is connected to a suction chamber formed in the compressor by means of a suction port. These suction ports are opened and closed by flapper type valves disposed in the compression chambers. Refrigerant gas in the suction chamber is drawn into the chamber through the corresponding flapper type valve which is forced open during the suction stroke of the piston moving from the top dead center to the bottom dead center. During the discharge stroke, when the pistons move from the bottom dead center to the top dead center, the suction ports are closed by the flapper type valves. Refrigerant gas, compressed in the compression chamber, causes a discharge valve in the discharge port to open, which allows the gas to be exhausted through a discharge port into the associated discharge chamber.

The flapper type suction valves are opened and closed by the pressure difference between the compression chambers and the suction chamber. When the pressure in the suction chamber is higher than in the compression chambers, as occurs during the suction stroke of the pistons moving from the top dead center to the bottom dead center, the flapper type suction valves are bent or deformed to open the suction ports. The force needed to elastically deform the flapper type valves acts as a suction resistance. Therefore, the flapper type valves will not open unless the pressure in the suction chamber becomes higher by some degree than that in the compression chambers. This introduces a timing delay respecting the opening of the flapper type valves.

In conventional compressors a lubricating oil mist is normally suspended in the refrigerant gas and supplies the internal parts of the compressor with lubrication.

The lubricating oil can be carried to wherever the refrigerant gas flows, and will stick between the flapper type valves and the surface of a valve plate to which the flapper type valves come in close contact. The adhesive property of the lubricating oil between the surface of the valve plate and flapper type valve causes a further delay in opening action of the flapper type valves. This delay in the opening of the flapper type valves reduces the flow rate of the refrigerant gas into the compression chambers, that is, it reduces the volumetric efficiency of the .compressor. In addition, even when the flapper type valves are opened, the elastic resistance of the flapper type valves contributes to the overall suction resistance of the gas flow into the compression chambers.

SUMMARY OF THE INVENTION

It is therefore a primary object of the present invention to provide a piston type compressor, which includes a rotary valve as a mechanism for supplying gas into compression chambers defined in cylinder bores, and which has a lower gas suction resistance and provides excellent volumetric efficiency.

It is another object of this invention to provide a piston type compressor which is designed to suppress the pressure acting on the outer surface of its rotary valve in order to reduce frictional contact between the rotary valve and the inner wall of a chamber accommodating the rotary valve, without being affected by variations in discharge pressure.

The piston type compressor embodying this invention can utilize the power to drive the compressor without waste and has an improved volumetric efficiency and an improved durability.

To achieve the foregoing and other objects and in accordance with the purpose of the present invention, an improved piston type compressor is provided. The improved compressor according to the present invention comprises a housing including a cylinder block, a gas suction chamber formed in the housing for receiving uncompressed gas, and a rotatable drive shaft mounted in the housing to penetrate the cylinder block. The cylinder block has a plurality of axial cylinder bores formed around the drive shaft. A plurality of pistons are respectively disposed in the cylinder bores. Each of the pistons defines a compression chamber in the associated cylinder bore, and is capable of reciprocating between a top dead center position where a volume of the associated compression chamber is at a minimum and a bottom dead center position where the volume of the associated compression chamber is at a maximum.

The improved compressor further comprises a piston driving mechanism for causing the pistons to reciprocate in cooperation with the drive shaft, a discharge chamber formed in the housing to lead compressed gas in the compression chambers outside the compressor, and a valve receiving chamber formed around the drive shaft in the cylinder block and having an inner wall surrounding the drive shaft. A rotary valve, fittingly received in the valve receiving chamber, has an outer surface urgable in close contact with the inner wall of the valve receiving chamber. The rotary valve is supported on the drive shaft and rotates in synchronism with rotation of the drive shaft. In addition, the rotary valve has a suction passage formed therein for guiding gases from the gas suction chamber to a compression chamber during a gas suction stroke.

A plurality of communication passages are formed in the cylinder block in association with the compression chambers, and provide gas communication between the compression chambers and the valve suction passage. Each of the communication passages has a first port open to an interior of an associated cylinder bore and a second port open to an interior of the valve receiving chamber that communicates with the valve suction passage. The first port is located at a position (P2) apart by a predetermined distance (L) from a top dead center position (P1) of an associated piston, whereby before the piston reaches the top dead center position, the first port is closed by an outer surface of the piston. The rotary valve has a bypass passage formed therein. The bypass passage permits one communication passage, isolated from both the compression chambers and the gas suction chamber by the outer surface of the associated piston and the outer surface of the rotary valve, to communicate with an another communication passage corresponding to a compression chamber in a compression stroke.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which

FIG. 1 is a longitudinal cross section showing a part of the internal mechanism of the compressor;

FIG. 2 is a longitudinal cross section showing the overall compressor;

FIG. 3 is a transverse cross section taken along the line A—A in FIG. 2;

FIG. 4 is a perspective view of a rotary valve of the compressor;

FIG. 5 is a diagram showing the development of the outer surface of the rotary valve shown in FIG. 4; and FIG. 6 is a graph showing the relation between the rotational angle of the rotary valve and the inner pressure of a compression chamber in a cylinder bore.

DETAILED DESCRIPTION OF THE PREFERRED EMBODIMENT

A swash plate type compressor equipped with double-headed pistons according to the present invention will now be described referring to the accompanying drawings.

Figure 2:
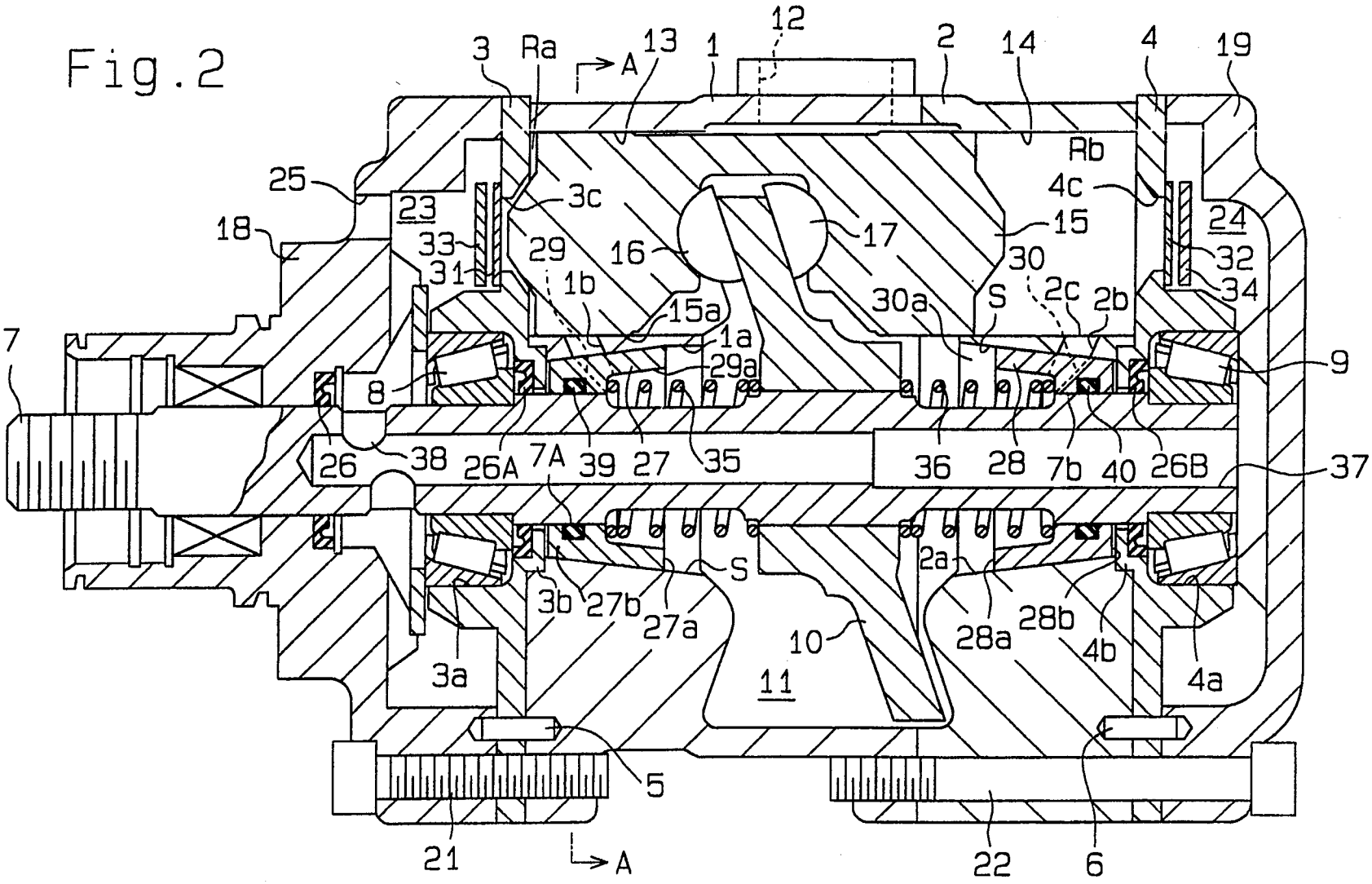

Front and rear cylinder blocks 1 and 2 are connected together and respectively have valve receiving chambers 1*a* and 2*a* formed through the center portions of those cylinder blocks 1 and 2 as shown in FIG. 2. Valve plates 3 and 4 are attached to the ends of the cylinder blocks 1 and 2. The valve plates 3 and 4 respectively have recessed receipt bores 3*a* and 4*a* and annular flange portions 3*b* and 4*b* protrusively provided in the vicinity of the receipt bores 3*a* and 4*a*. The flange portions 3*b* and 4*b* are respectively disposed within the cylinder blocks 1 and 2 to position the valve plates 3 and 4 with respect to the cylinder blocks 1 and 2.

Pins 5 and 6 are attached to the valve plates 3 and 4 and the cylinder blocks 1 and 2 so as to position the valve plate 3 and 4 and to inhibit the relative rotations of the valve plates 3 and 4 to the cylinder blocks 1 and 2. A drive shaft 7 is rotatably supported in the receipt bores 3*a* and 4*a* via tapered roller bearings 8 and 9. The tapered roller bearings 8 and 9 receive the thrust force and radial force from the drive shaft 7. A swash plate 10 is securely fitted over the drive shaft 7.

Gas inlet ports 12 are formed in the cylinder block 1 to connect a swash-plate chamber 11, formed in the cylinder blocks 1 and 2, to a refrigerant gas inlet passage (not shown) in an air conditioning system in a vehicle.

Figure 3:
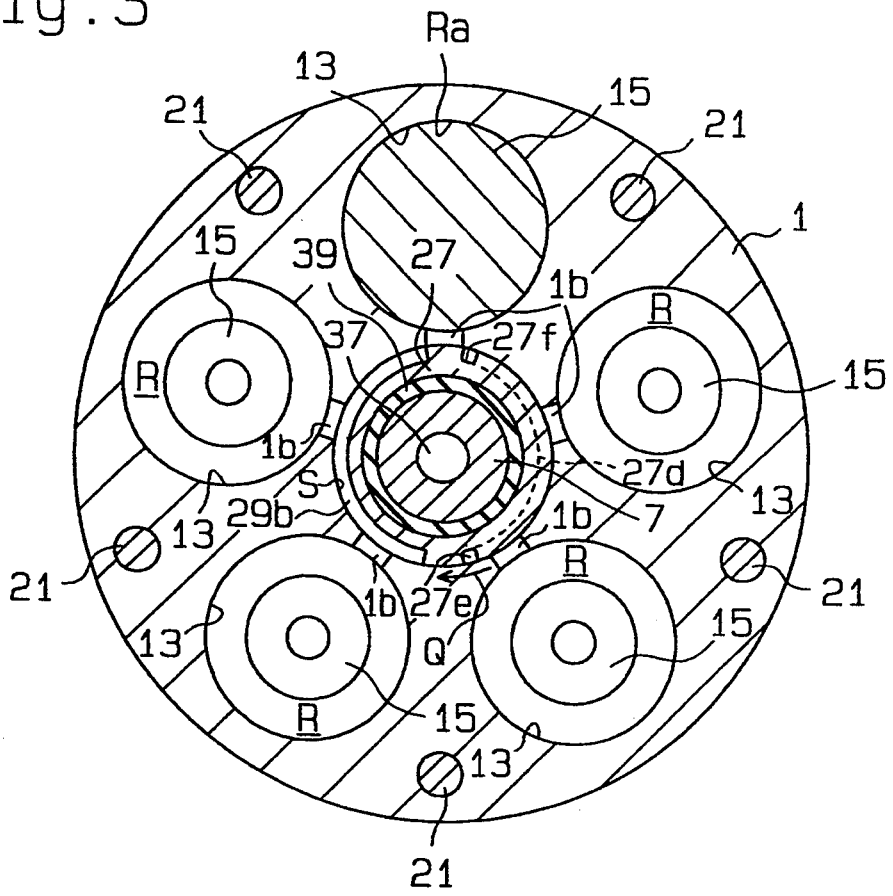

As shown in FIGS. 2 and 3, a plurality of cylinder bores 13 and 14 (five cylinder bores in this embodiment) are formed equiangularly in the cylinder blocks 1 and 2 around the drive shaft 7. The individual cylinder bores 13 of the front block 1 respectively correspond to the cylinder bores 14 of the rear block 2. A double-headed piston 15 is retained in each pair of cylinder bores 13 and 14 (five pairs in this embodiment) in such a way that the piston 15 can reciprocate in the cylinder bores. The double-headed piston 15 has a shape of two piston heads connected to each other. The peripheral portion of the swash plate 10 is placed between both piston heads, with hemispherical shoes 16 and 17 provided between the piston heads and the swash plate 10. The rotation of the swash plate 10 together with the drive shaft 7 causes all the double-headed pistons 15 to reciprocate in the respective cylinder bores 13 and 14.

As shown in FIG. 2, a front housing 18 is attached to the front end of the front cylinder block 1, and a rear housing 19 is attached to the rear end of the rear cylinder block 2. The front cylinder block 1, the front valve plate 3 and the front housing 18 are fastened by a plurality of bolts 21. The front and rear cylinder blocks 1 and 2, the rear valve plate 4 and the rear housing 19 are fastened by a plurality of bolts 22 (here only one is shown).

Front and rear discharge chambers 23 and 24 are defined by the front housing 18 and the front valve plate 3 and by the rear housing 19 and the rear valve plate 4, respectively. Compression chambers Ra and Rb are defined in the respective pairs of cylinder bores 13 and 14 by the associated double-headed pistons 15, the reciprocating motion of which creates suction and compression pressures within chambers Ra and Rb. These chambers communicate with the discharge chambers 23 and 24 via discharge ports 3*c* and 4*c* formed in the respective valve plates 3 and 4.

Flapper type discharge valves 31 and 32 and retainers 33 and 34 are secured onto the respective valve plates 3 and 4 by bolts (not shown). The discharge valves 31 and 32 control the opening and closing of the associated discharge ports 3*c* and 4*c*. The retainers 33 and 34 restrict the opening angles of the associated discharge valves 31 and 32 to prevent the valves 31 and 32 from being damaged.

The front end of the drive shaft 7 protrudes from the front housing 18, and is coupled to the driving source (not shown), such as the engine of an automobile. The rear end of the drive shaft 7 protrudes into the rear discharge chamber 24. The drive shaft 7 has a discharge passage 37 formed along the axial center. This discharge passage 37 is open to the rear discharge chamber 24, and communicates with the front discharge chamber 23 via an outlet port 38 formed in the drive shaft 7 within the discharge chamber 23. The front discharge chamber 23 communicates with a refrigerant gas outlet passage (not shown) in the aforementioned vehicular air conditioning system via an outlet port 25 formed in the front housing 18. Thus, the rear discharge chamber 24 also communicates with the refrigerant gas outlet passage via the discharge passage 37, the outlet port 38, the front discharge chamber 23 and the outlet port 25.

A lip seal 26 is provided around the drive shaft at the center portion of the front housing 18 to prevent the refrigerant gas from leaking from the discharge chamber 23 outside the compressor along the surface of the drive shaft 7. Lip seals 26A and 26B are provided around the drive shaft 7, adjacent to the respective annular flange portions **3*b* and 4*b* to prevent the compressed refrigerant gas from leaking into the plate chamber 11 from the discharge chambers 23 and 24**.

Figure 1:
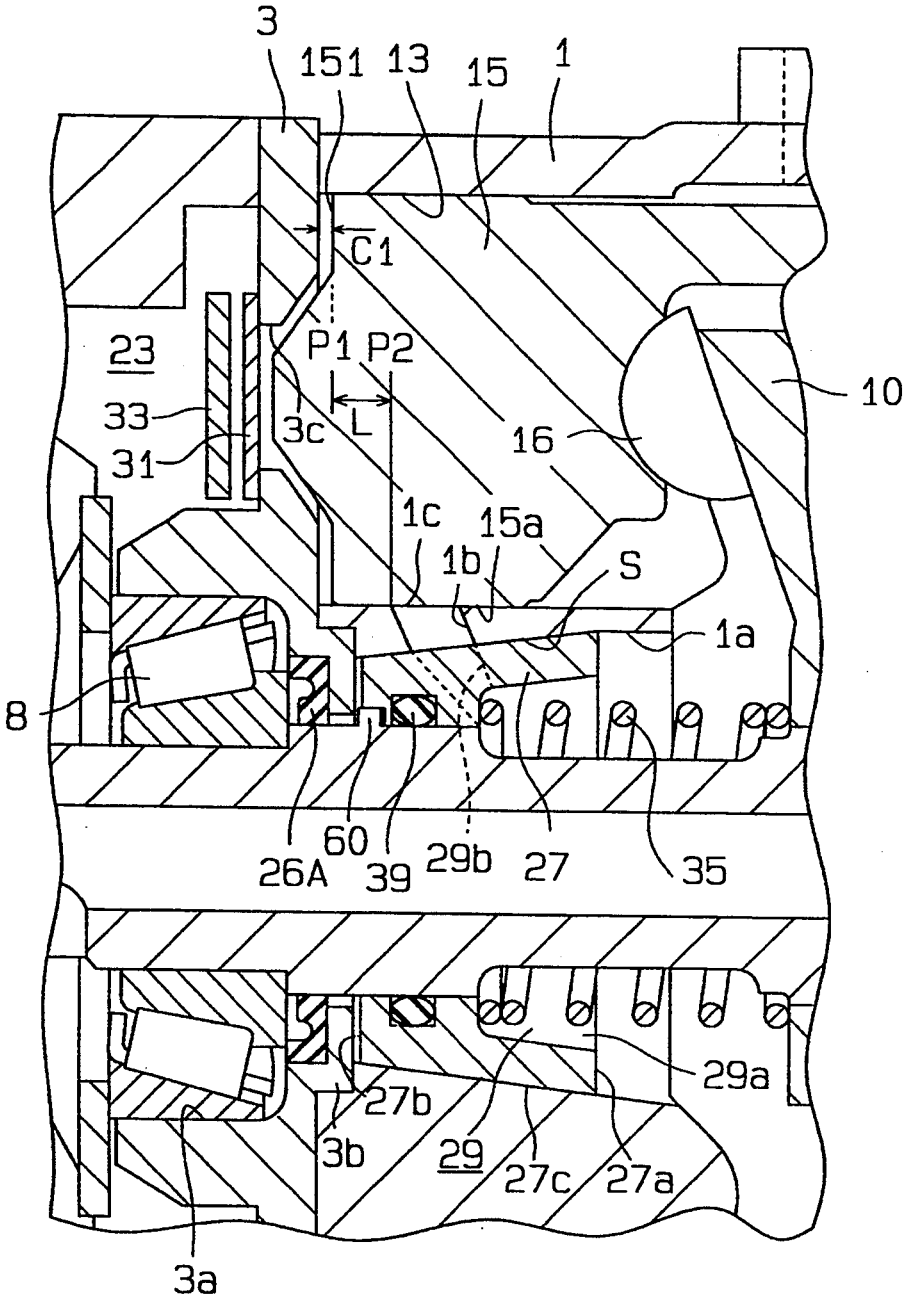
FIGS. 1 through 6 illustrate a piston type compressor according to one embodiment of this invention.
Figure 4:
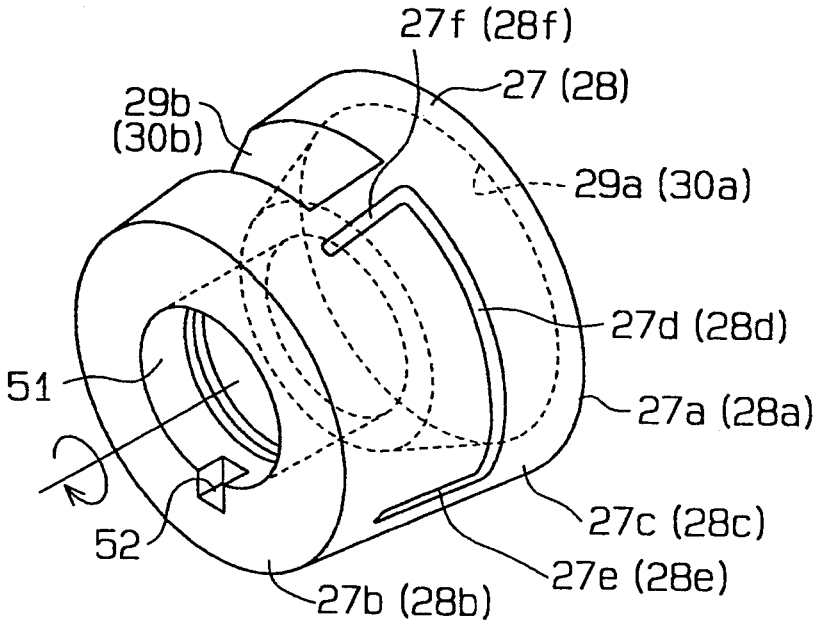

As shown in FIG. 2, rotary valves 27 and 28 are mounted on two annular raised portions **7*a* and 7*b* of the drive shaft 7, with seal rings 39 and 40 disposed between the rotary valves 27 and 28 and the drive shaft 7, in such a manner that the rotary valves 27 and 28 are movable in the thrust direction (the direction along the drive shaft 7). The rotary valves 27 and 28 are respectively retained in the valve receiving chambers 1*a* and 2*a* and can rotate in the direction of an arrow Q in FIG. 3 together with the drive shaft 7. As shown in FIG. 4, each of the rotary valves 27 and 28 has a hole 51 in which the drive shaft 7 is fitted, and a recess 52 formed to face the hole 51. As shown in FIG. 1, the drive shaft 7 has projections 60 (only one shown) corresponding to the recesses 52 of the rotary valves 27 and 28, so that the projections 60 and recesses 52 are designed to permit the rotary valves to rotate together with the drive shaft 7 and to slightly slide along the drive shaft 7**.

Each of the valve receiving chambers la and **2*a* has a tapered inner wall S whose inside diameter becomes wider toward the swash plate 10. The rotary valves 27 and 28 respectively have tapered outer surfaces 27*c* and 28*c* (truncated cone shapes) in association with the respective valve receiving chambers 1*a* and 2*a*. Therefore, both tapered outer surfaces 27*c* and 28*c* firmly contact the tapered inner walls S of the associated valve receiving chambers 1*a* and 2*a*. As shown in FIG. 2, large-diameter end portions 27*a* and 28*a* of the rotary valves 27 and 28 face each other with the plate chamber 11 in between. A small-diameter end portion 27*b* of the rotary valve 27 is directed toward the front discharge chamber 23, and a small-diameter end portion 28*b* of the rotary valve 28 is directed toward the rear discharge chamber 24**.

As shown in FIG. 2, the rotary valves 27 and 28 are provided inside with suction passages 29 and 30, respectively. As shown in FIG. 4, the suction passage 29 (30) of the rotary valve 27 (28) has an inlet **29*a* (30*a*) open to the large-diameter end portion 27*a* (28*a*), and an outlet 29*b* (30*b*) open to the outer surface 27*c* (28*c*)**.

It is apparent from FIGS. 2 and 3 that five suction ports **1*b* corresponding to five cylinder bores 13 are equiangularly formed in the front cylinder block 1. The inner end of each suction port 1*b* is open to the tapered inner wall S of the valve receiving chamber 1*a*, and the outer end is open to the inner wall of the associated compression chamber R. Further, the inner end of each suction port 1*b* is positioned within the circulation area of the outlet 29*b* of the suction passage 29 when the rotary valve 27 rotates. Therefore, the individual compression chambers in the front cylinder bores 13 can communicate with the plate chamber 11 via the associated suction ports 1*b* and the associated suction passage 29 of the rotary valve 27**.

The rear cylinder block 2, like the front cylinder block 1, has five suction ports **2*b* (only one shown in FIG. 2) equiangularly formed in association with five cylinder bores 14. The inner end of each suction port 2*b* is positioned within the circulation area of the outlet 30*b* of the suction passage 30 when the rotary valve 28 rotates. Therefore, the individual compression chambers in the rear cylinder bores 14 can communicate with the plate chamber 11 via the associated suction ports 2*b* and the associated suction passage 30 of the rotary valve 28**.

As shown in FIG. 1, an outlet **1*c* of the suction port 1*b* to the cylinder bore 13 is so located at a position P2 separated by a given distance L from the top dead center P1 of the left piston head, in a predetermined clearance Cl formed between a main end face 151 of the left head of the double-headed piston 15 and the surface of the valve plate 3. Therefore, when the main end face 151 is arranged between the top dead center P1 and the position P2, the outlet 1*c* is completely closed by the outer surface 15*a* of the piston 15. The outlet 2*c* of the suction port 2*b* for the entrance to the cylinder bore 14 is positioned in the same manner as the outlet 1*c***.

Suction pressure acts in the plate chamber 11, and the pressures in the compression chambers Ra and Rb vary between the suction pressure and the discharge pressure. When the pressures in the compression chambers Ra and Rb are at the level of the discharge pressure, the high-pressure refrigerant gases in the compression chambers Ra and Rb act on the tapered outer surfaces **27*c* and 28*c* of the rotary valves 27 and 28 via the suction ports 1*b* and 2*b*. However, according to this embodiment, springs 35 and 36 are disposed between the center boss portion of the swash plate 10 and the rotary valves 27 and 28 to urge the associated rotary valves 27 and 28 toward the tapered roller bearings 8 and 9. This causes the tapered outer surfaces 27*c* and 28*c* to press against the tapered inner walls S of the valve receiving chambers 1*a* and 2*a*. Therefore, the high-pressure gases in the compression chambers Ra and Rb can be prevented from leaking into the plate chamber 11 between the tapered outer surfaces 27*c* and 28*c*** and the respective tapered inner walls S.

The combination of the rotary valves 27 and 28 of a truncated cone shape and the springs 35 and 36 prevent the leakage of the compressed refrigerant gas and improves the volumetric efficiency of the compressor in the compression stroke. Such a shape of the rotary valves 27 and 28 has the following advantages in addition to the facilitation of their fitting into the associated valve receiving chambers **1*a* and 2*a***.

The contact-sliding of the outer surfaces **27*c* and 28*c* of the rotary valves 27 and 28 to the inner walls S of the valve receiving chambers 1*a* and 2*a* may cause wear to the outer surfaces and inner walls. Even if such wear occurs, however, the springs 35 and 36 permit the outer surfaces 27*c* and 28*c* of the rotary valves 27 and 28 to fittingly contact the inner walls S of the valve receiving chambers 1*a* and 2*a*, thereby ensuring airtight seal between the rotary valves 27 and 28 and the associated valve receiving chambers 1*a* and 2*a***.

Even if the linear expansion coefficients of the rotary valves 27 and 28 respectively differ from those of the cylinder blocks 1 and 2, airtight sealing can always be achieved. In other words, a sealing fit can be maintained regardless of a temperature change in the compressor. Further, the rotary valves 27 and 28 may be formed of a synthetic resin lighter than metal according to this embodiment. The reduction of the weights of the rotary valves 27 and 28 will contribute to making the overall compressor lighter.

Figure 5:
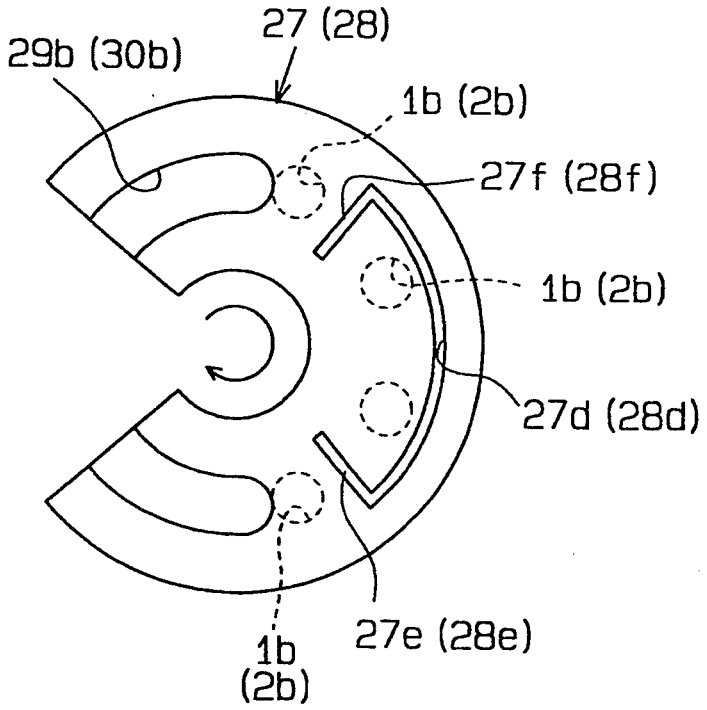

As shown in FIGS. 3 and 4, recessed bypass passages 27*d* and 28*d* are formed in the tapered outer surfaces 27*c* and 28*c* of the rotary valves 27 and 28. As shown in FIG. 5, the bypass passage 27*d* (28*d*) extends along the rotational direction of the rotary valve 27 (28) in an arc locus while avoiding the area where the outer surface 27*c* (28*c*) of the rotary valve 27 (28) would contact the opening of the suction port 1*b* (2*b*). The bypass passages 27*d* and 28*d* respectively have first communication grooves 27*e* and 28*e*, located at the downstream side of the rotational direction of the rotary valves 27 and 28, and second communication grooves 27*f* and 28*f*, located at the upstream side of the rotational direction.

The first communication groove 27*e* (28*e*) temporarily communicates with the suction port 1*b* (2*b*) of the cylinder block 1 (2) shortly after the outlet 29*b* (30*b*) of the suction passage 29 (30) is closed by the tapered inner wall S of the associated valve receiving chamber 1*a* (2*a*). The second communication groove 27*f* (28*f*) temporarily communicates with the suction port 1*b* (2*b*) of the cylinder block 1 (2) shortly before the outlet 29*b* (30*b*) communicates with the suction port 1*b* (2*b*). Shortly after one suction port 1*b* (2*b*) is sealed by the outer surface 15*a* of the piston and the outer surface 27*c* (28*c*) of the rotary valve 27 (28), the refrigerant gas in the sealed space is led via the bypass passage 27*d* (28*d*) into the suction port 1*b* (2*b*) located one suction port away from that sealed suction port on the downstream side of the rotational direction (see FIGS. 3 and 5).

Usually, in a conventional compressor equipped with a flapper type suction valve in the vicinity of the suction port of the compression chamber, a lubricating oil attached to the valve may cause the suction valve to firmly adhere to the plate surface which the valve contacts. With too much adherence, the opening of the suction valve is undesirably delayed. This delay and the large suction resistance from the elasticity of the suction valve operate to reduce the volumetric efficiency of the compressor.

The use of the rotary valves 27 and 28 which rotate together with the drive shaft 7 as in this invention, however, avoid the difficulties relating to the adherence of lubricating-oil between the suction valves and the plate surfaces as well as the disadvantage occasioned by the suction resistance produced by the elastic resistance of the suction valves. This results due to the fact that when pressure in the compression chamber R, Ra or Rb becomes slightly less than the suction pressure in the plate chamber 11, the refrigerant gas spontaneously flows into the compression chamber R, Ra or Rb. Because of the use of the rotary valves 27 and 28 instead of the flapper type suction valves, this invention significantly improves the volumetric efficiency as compared with the conventional compressor which uses the flapper type suction valves.

The action of the compressor of this embodiment will be discussed below. In the illustration as shown in FIG. 2, the double-headed piston 15 at the topmost position is at the top dead center with respect to the left cylinder bore 13, and is at the bottom dead center with respect to the right cylinder bore 14. At this time, the outlet 29*b* of the suction passage 29 in FIG. 1 is situated slightly apart from suction port 1*b*, associated with the compression chamber Ra and topmost cylinder bore 13 as shown in FIG. 3. Outlet 30*b* of the suction passage 30 is situated slightly apart from a where it would be blocked from the suction passage 2*b* of the cylinder bore 14 though not shown.

When the double-headed piston 15 moves rightward from the position shown in FIG. 2, the compression chamber Ra is in the suction stroke where the piston head in the left cylinder bore 13 moves toward the bottom dead center from the top dead center. In this suction stroke, the suction passage 29 communicates with the compression chamber Ra of the cylinder bore 13, allowing the refrigerant gas in the plate chamber 11 to be led into the compression chamber Ra via the suction passage 29 and the suction port 1*b*. When the double-headed piston 15 moves rightward from the position shown in FIG. 2, the compression chamber Rb in the right cylinder bore 14 is in the compression stroke where the associated piston head moves toward the top dead center from the bottom dead center. In this compression stroke, the communication of the suction passage 30 with the compression chamber Rb in the cylinder bore 14 is blocked. Therefore, the compressed refrigerant gas in the compression chamber Rb is discharged into the rear discharge chamber 24 from the discharge port 4*c* while pushing the discharge valve 32 back. These suction, compression and discharge processes of the refrigerant gas are similarly performed for the compression chambers R of other cylinder bores 13 and 14.

Figure 6:
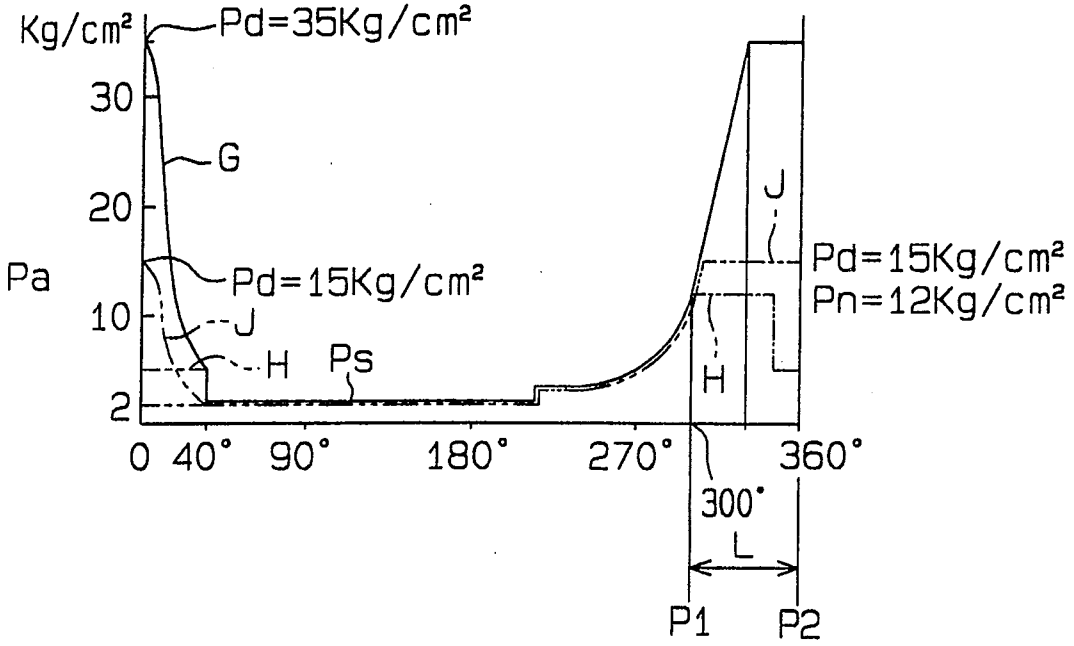

The graph in FIG. 6 shows the relation between the internal pressure Pa in the compression chamber Ra in the cylinder bore 13 and the rotational angle of the rotary valve 27 (drive shaft 7) which is also a function of the position of the piston 15. Referring to the graph, a description will be given of the operation of the compressor in the cases where the cooling load is large and where the cooling load is small.

Suppose that the cooling load is large and the discharge pressure Pd of the compressor is high (e.g., 35 $Kg/cm^2$). When the piston 15 moves toward the bottom dead center from the top dead center in the left cylinder bore 13, the compressed gas remaining in the compression chamber Ra of the top volume corresponding to the clearance Cl once again expands. Then, the pressure Pa in the compression chamber Ra rapidly drops from 35 $Kg/cm^2$ as indicated by a solid line G in FIG. 6. When the rotary valve 27 rotates approximately 40 degrees, the outlet 1*c* of the suction port 1*b*, closed by the outer surface 15*a* of the piston 15, is communicatively opened to the compression chamber Ra. Consequently, the compression chamber Ra and the plate chamber 11 communicate with each other via the suction passage 29 and the suction port 1*b*. This allows the refrigerant gas to be forced into the compression chamber Ra from the plate chamber 11, so that the pressure Pa in the compression chamber Ra effectively becomes the suction pressure (e.g., 2 $Kg/cm^2$).

When the piston 15 moves again toward the top dead center, after having reached the bottom dead center, the suction port 1*b* is closed by the outer surface 27*c* of the rotary valve 27. At this time, the refrigerant gas drawn in the compression chamber Ra is compressed, raising the pressure Pa in the compression chamber Ra. When the piston 15 comes between the bottom dead center and the top dead center (about 300 degrees by the rotational angle of the drive shaft 7), the outlet 1*c* of the suction port 1*b* is closed by the outer surface 15*a* of the piston 15 so that the suction port 1*b* becomes sealed or isolated from the cylinder bore 13 and the plate chamber 11. As a result, the pressure Pn in the suction port 1*b* is held at the intermediate pressure (e.g., 12 Kg/cm$^2$) as indicated by a chain line H in FIG. 6.

Shortly after suction part 1*b* is sealed, when the first communication groove 27*e* of the bypass passage 27*d* crosses the opening of the sealed first suction port 1*b*, the first communication groove 27*e* temporarily communicates with the first suction port 1*b*. While the second communication groove 27*f* crosses the opening of the third suction port 1*b* from the first suction port 1*b* in synchronism with the above communication, the second communication groove 27*f* temporarily communicates with the third suction port 1*b*. Therefore, the refrigerant gas under intermediate pressure Pn in the first suction port 1*b* is supplied to the compression chamber Ra in the compression stroke, via the bypass passage 27*d* including the first and second communication grooves 27*e* and 27*f*, and the third suction port 1*b*.

The curve indicated by the solid line G in FIG. 6 has a step portion between the rotational angle of 180 degrees and the rotational angle of 270 degrees, which indicates a slight rise of the pressure. The existence of this step portion originates due to the supply of the refrigerant gas in the first suction port 1*b* to its compression chamber Ra via the bypass passage 27*d*. This method improves the volumetric efficiency better than the method of returning the refrigerant gas, sealed in the first suction port 1*b*, directly to the plate chamber 11. This in turn allows the suction pulsation, vibration and noise to be suppressed better as well.

When the pressure Pa in the compression chamber Ra reaches the discharge pressure Pd in accordance with the movement of the piston 15 to the top dead center, the discharge valve 31 is pushed back, allowing the compressed refrigerant gas to be discharged into the front discharge chamber 23. Even when the pressure Pa in the compression chamber Ra rises, this high pressure will not act on the tapered outer surface 27*c* of the rotary valve 27.

Suppose now that the discharge pressure Pd of the compressor is low (e.g., 5 Kg/cm$^2$) due to a light cooling load. At this time, the pressure Pa in the compression chamber Ra changes as indicated by the chain line J in FIG. 6 in accordance with the reciprocating motion of the piston 15. In this case too, the pressure Pn in the suction port 1*b*, sealed by the surface 15*a* of the piston and the valve surface 27*c*, is kept under intermediate pressure (e.g., 12 Kg/cm$^2$), as in the case of a large cooling load, so long as the suction pressure is kept constant. Slightly after that event, the gas under intermediate pressure in the suction port 1*b* is supplied via the first communication groove 27*e*, the bypass passage 27*d* and the second communication groove 27*f* to another suction port 1*b* associated with another compression chamber Ra in compression stroke.

According to this invention, the pressure acting on the tapered outer surface 27*c* (28*c*) of the rotary valve 27 is under intermediate pressure Pn in the sealed suction port 1*b*. This design will reduce the pressure acting on the valve outer surface as compared with the design that causes the discharge pressure to directly act on the valve outer surface. According to this invention, therefore, partial pressure acting in the axial direction so as to separate the rotary valve 27 (28) away from the inner wall S of the valve receiving chamber 1*a* (2*a*) is relatively small. The elastic force of the spring 35 (36) can be set low in accordance with the small partial pressure. The low spring force reduces the pressure against the inner wall S of the receiving chamber for the rotary valve 27 (28), thereby reducing the slide-oriented friction between the inner wall of the receiving chamber and the valve outer surface. This suppresses the wear or gall of the outer surface of the rotary valve 27 (28), improves the durability of the compressor and reduces the power needed to drive the compressor.

The timing for closing the suction port 1*b* (2*b*) by the piston 15 is not limited to the aforementioned rotational angle of 300 degrees as long as the pressure in the sealed suction port 1*b* is kept at the intermediate pressure Pn lower than the maximum discharge pressure Pd (35 Kg/cm$^2$).

Although only one embodiment of the present invention has been described herein, it should be apparent to those skilled in the art that the present invention may be embodied in many other specific forms without departing from the spirit or scope of the invention. Particularly, it should be understood that this invention may be embodied in the following manner.

The rotary valves 27 and 28 may be formed columnar, and the receiving chambers 1*a* and 2*a* may be formed cylindrical to match with the shape of the rotary valves. In this case, the intermediate pressure Pn in the suction port 1*b* or 2*b* sealed by the outer surface of the associated piston and the outer surface of the associated rotary valve act on the outer surface of the cylindrical rotary valve. This reduces the local pressure of the outer surface of the rotary valve on the inner wall of the associated receiving chamber. As a result, the wear or gall of the sliding surface, which is caused by the rotation of the rotary valve, is suppressed, thus preventing loss of the power for driving the drive shaft.

Although the bypass passages 27*d* and 28*d* in the above-described embodiment are grooves formed in the outer surfaces 27*c* and 28*c* of the rotary valves 27 and 28, the bypass passages may be formed inside the rotary valves 27 and 28 as long as both ends of each bypass passage are open to the outer surface of the associated rotary valve.

The individual rotary valves 27 and 28 may be coupled in spline fashion to the drive shaft 7.

This invention may be adapted for a rocking swash plate type variable displacement compressor, besides the above-described swash plate type compressor equipped with double-headed pistons.

Therefore, the present examples and embodiment are to be considered as illustrative and not restrictive and the invention is not to be limited to the details given herein, but may be modified within the scope of the appended claims.

What is claimed is:

1. A piston type compressor comprising:

a housing including a cylinder block;

a gas suction chamber formed in said housing, for receiving uncompressed gas;

a rotatable drive shaft mounted in said housing to extend into said cylinder block, said cylinder block having a plurality of axial cylinder bores formed around said drive shaft;

a plurality of pistons respectively disposed in said cylinder bores, each of said pistons defining a compression chamber in the associated cylinder bore and being capable of reciprocating between a top dead center position where a volume of the associated compression chamber is at a minimum and a bottom dead center position where said volume of the associated compression chamber is at a maximum;

a piston driving mechanism for causing said pistons to reciprocate in cooperation with said drive shaft;

a discharge chamber formed in said housing, for receiving compressed gas contained in said compression chambers outside the compressor;

a valve receiving chamber formed around said drive shaft in said cylinder block and having an inner wall surrounding said drive shaft;

a rotary valve fittingly received in said valve receiving chamber and having an outer surface urged contacting relationship with said inner wall of said valve receiving chamber, said rotary valve being supported on said drive shaft to rotate in synchronism with the rotation of said drive shaft, said rotary valve having a suction passage formed therein for providing gases contained in said gas suction chamber to a compression chamber during said chamber's gas suction stroke;

a plurality of communication passages formed in said cylinder block in association with said compression chambers, for providing gas communication between said compression chambers and said valve suction passage;

each of said communication passages having a first port open to the interior of one of said cylinder bores and a second port open to an interior of said valve receiving chamber and communicable with said valve suction passage, said first port being located at a position (P2) apart by a predetermined distance (L) from a top dead center position (P1) of one of said pistons, wherein before said piston reaches said top dead center position, said first port is closed by an outer surface of said piston; and said rotary valve having a bypass passage formed therein for permitting one communication passage, isolated from both said compression chambers and said gas suction chamber by said outer surface of the associated piston and said outer surface of said rotary valve, to communicate with another communication passage corresponding to a compression chamber in a compression stroke.

2. The compressor according to claim 1, wherein said rotary valve has the shape of a substantially truncated cone, and said valve receiving chamber has a mortar shape corresponding to said shape of the rotary valve.

3. The compressor according to claim 2, wherein said bypass passage includes a recessed groove formed on said outer surface of said rotary valve.

4. The compressor according to claim 3, wherein said bypass passage includes a main recessed portion formed along a circumferential direction of said outer surface of said rotary valve, said main recessed portion partially extending around outer surface where said second ports of said communication passages contact said outer surface of said rotary valve; and wherein said bypass passage further includes two recessed portions crossing said partial region and connected to said main recessed portion.

5. The compressor according to claim 2, wherein said suction passage formed in said rotary valve has an inlet open to an end face of said rotary valve and an outlet open to said outer peripheral surface of said rotary valve.

6. The compressor according to claim 2 further comprising means for holding said rotary valve within said valve receiving chamber such that a tapered outer surface of said rotary valve fittingly contacts said inner wall of said valve receiving chamber.

7. The compressor according to claim 6, wherein said holding means includes a spring for urgingly fitting said rotary valve into said valve receiving chamber.

8. The compressor according to claim 1, wherein a position of each of said pistons in said cylinder bores is a function of a rotational angle of said rotary valve; and wherein said predetermined distance (L) is set to a distance between said top dead center position (P1) corresponding to a rotational angle of 360 degrees and a piston position (P2) where said rotational angle of said rotary valve is 300 degrees.

9. The compressor according to claim 1, wherein said piston driving mechanism includes:

an inclined swash plate fixed on said drive shaft, for causing undulating movement in accordance with rotation of said drive shaft; and means, provided between said swash plate and each of said pistons, for transmitting said undulating movement to said pistons to cause said pistons to reciprocate.

10. The compressor according to claim 1 further comprising:

a valve plate fitted on said housing, for defining said compression chambers in cooperation with inner walls of said cylinder bores and said pistons, said valve plate having a plurality of discharge ports, each of which permits the associated compression chamber to communicate with said discharge chamber; and a plurality of flapper type discharge valves attached on said valve plate, each of said discharge valves performing the open/close control of the associated discharge port.

* * * * *